United States Patent [19]

Slack

[11] 3,981,405

[45] Sept. 21, 1976

[54] ROTATABLE DISPLAY AND STORAGE STAND FOR FLOOR COVERINGS

[75] Inventor: John A. Slack, Dalton, Ga.

[73] Assignee: World Carpets, Dalton, Ga.

[22] Filed: June 16, 1975

[21] Appl. No.: 586,856

[52] U.S. Cl. ..... 211/70; 211/44; 211/163

[51] Int. Cl.[2] ..... A47F 7/18

[58] Field of Search ..... 248/131, 349, 158, 415; 211/40, 41, 44, 45, 46, 47, 60–69.1, 70, 78, 95, 115, 126, 128, 129, 131, 133, 144, 163; 312/11, 10, 125, 135

[56] References Cited

UNITED STATES PATENTS

| | | | |
|---|---|---|---|
| 663,838 | 12/1900 | White | 211/70 |
| 1,194,436 | 8/1916 | Smith | 211/131 X |
| 1,927,010 | 9/1933 | Best | 211/60 R X |
| 1,983,167 | 12/1934 | Chisolm | 211/44 |
| 2,376,955 | 5/1945 | Ball | 211/60 R |
| 2,526,245 | 10/1950 | Lathrop | 211/60 R X |
| 3,161,294 | 12/1964 | Meuche | 211/41 |
| 3,170,741 | 2/1965 | Richards, Jr. | 211/144 X |
| 3,777,895 | 12/1973 | Weinstein et al. | 211/163 X |

*Primary Examiner*—Roy D. Frazier
*Assistant Examiner*—Terrell P. Lewis
*Attorney, Agent, or Firm*—Cameron, Kerkam, Sutton, Stowell & Stowell

[57] ABSTRACT

A display and storage stand for floor coverings is disclosed as including an upright standard upon which a display and storage assembly is rotatably mounted. The assembly includes a first or bottom support disc for receiving the bottom edge of the rolled floor coverings, to be stored and displayed, a spacing disc supported above the first support disc and having first and second notches therein disposed about the periphery thereof. The set of first notches are of a configuration to receive a single rolled covering, whereas the second notches are of sufficient size and of such configuration to receive at least two rolls of the floor covering. The standard includes leg portions for supporting an upright, vertically disposed portion about which the display and storage assembly is rotatably mounted. Suitable bearings are disposed upon the upper surface of the leg portions whereby the first support disc may readily slide thereover to permit the rotation of the display and storage assembly.

5 Claims, 5 Drawing Figures

ROTATABLE DISPLAY AND STORAGE STAND FOR FLOOR COVERINGS

BACKGROUND OF THE INVENTION

FIELD OF THE INVENTION

This invention relates to rack structures, and more particularly, to such structures for displaying articles in the form of sheet materials, such as floor covering and in particular rolls of carpets.

In retail business establishments, it is desired to display samples of sheet materials such as floor coverings to which customers can refer for making their selections. It is desirable to display a significant number of floor coverings showing the various patterns, styles, makes and color of floor covering. First, it is desired to most attractively display such samples to permit ready access by a potential customer, while utilizing a relatively small amount of space so that valuable floor area of the establishment is not wasted or lost. In this regard, it is desirable to display as large a surface area of the floor coverings as possible to permit the customer to visualize the pattern and color scheme of the floor covering and to permit ready withdrawal of a selected covering for closer inspection and evaluation of the desirability of such a covering in his own residence or place of business. Further, such a display should provide for storage of floor covering, especially those coverings which are more popular and whose sales are the highest.

Such a display stand should be capable of being shipped in an unassembled form by a suitable carrier, e.g., the mails, and then reassembled at the retail establishment with readily available tools. The parts of the stand should be constructed to permit ready assembly, while ensuring the high overall structural strength and rigidity of the assembled stand.

As described in U.S. Pat. Nos. 2,643,774 and 2,946,454, floor coverings and in particular samples of carpets are displayed upon devices known as water fall sample display racks on which a plurality of carpet samples are secured in overlapping relationship in such a manner that the edge of each sample has an exposed area of several inches. Typically, such water fall display racks include means for clamping samples to the front of a curved base of the rack so that they cannot be removed without substantial inconvenience. Further, only a limited area of the carpet is displayed, even though others of the display samples are pulled back or disposed in a noncovering position. Thus, it is difficult for the potential customer to visualize what a large area of the sample would look like. Further, such samples, even though small, may be relatively heavy, thus making it difficult to move one sample to see another. In this connection, it may be necessary to lift a plurality of samples, which may be difficult for a female customer.

SUMMARY OF THE INVENTION

It is therefore an object of this invention to provide a new and novel display stand for displaying floor coverings such as carpets that requires a relatively small floor space, while providing a display of a large area of the floor covering.

It is a further object of this invention to provide a new and novel display stand that is capable of storing additional floor coverings and for displaying and storing coverings in rolled form.

It is a further object of this invention to provide a new and novel storage and display stand for rolled floor coverings that is capable of being shipped in compact unassembled form and of such structure to permit ready assembly at the point of utilization.

In accordance with these and other objects, there is shown in accordance with the teachings of this invention a display and storage stand for a plurality of floor coverings, including an upright standard and a display and storage assembly rotatably mounted thereon. The assembly includes in one illustrative embodiment of this invention a first or lower support disc upon which the lower edge of a rolled floor covering rests and a spacing disc supported in a spaced relationship above the first support disc and having first and second sets of notches disposed in the periphery thereof for receiving rolled samples of the floor coverings. In particular, the first set of notches are of such size and configuration to receive a single rolled covering, whereas the second set of openings are of sufficient size and of such configuration to receive a plurality of rolled floor coverings, whereby the one received adjacent the disc periphery is suitably displayed and the one(s) disposed remotely of the periphery of the spacing disc is effectively stored.

In one aspect of this invention, the upright standard includes at least two leg portions, extending from the upright portion of the standard and secured thereto to make the stand free standing, and a bearing surface, e.g., a ball bearing, to receive and permit the relatively frictionless movement of the lower surface of the first support disc thereacross.

In a further aspect of this invention, the display and storage stand of this invention is so constructed to permit ready assembly from a plurality of relatively compact parts. To this end, the first or bottom support disc is spaced from the spacing disc by a plurality of U-shaped brackets, each having a first leg portion to be connected to the first support disc, a bite portion and a second leg portion to be connected to the spacing disc. The bottom support disc has an opening therein and the bite portions of the U-shaped brackets are so disposed to form a space through which the upright portion of the standard extends, whereby the rotatable storage and display stand is disposed in a generally upright position and is rotatably mounted with respect to the standard, whereby the potential customer may readily rotate the stand to view each sample of the floor covering held therein.

BRIEF DESCRIPTION OF THE DRAWINGS

These and other objects and advantages of the present invention will become more apparent by referring to the following detailed description and accompanying drawings, in which.

DESCRIPTION OF THE PREFERRED EMBODIMENT

Figure 1:
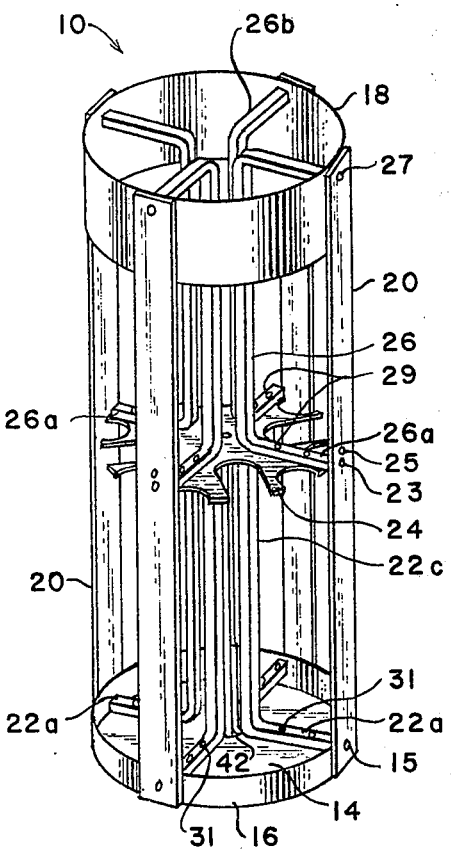
FIG. 1 is a perspective view of the rotatable display and storage stand in accordance with the teachings of this invention.
Figure 2:
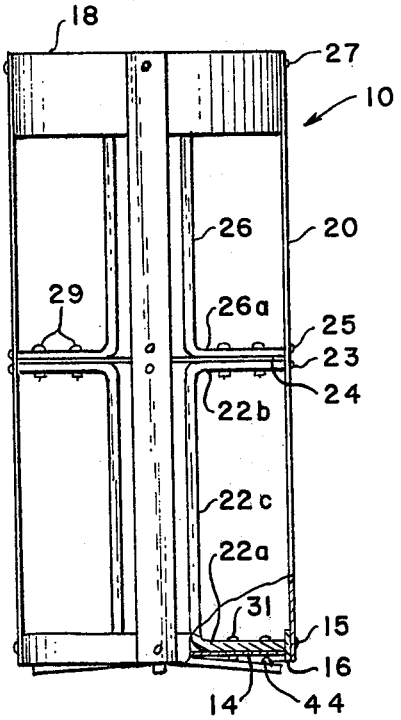
FIG. 2, is a side view, partially broken away, of the display and storage stand of FIG. 1, as mounted upon an upright standard.
Figure 5:
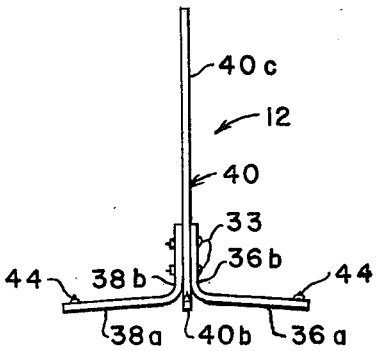
FIG. 5 is a side view of the upright standard, shown in part in FIG. 2.

Referring now to the drawings and in particular to FIGS. 1 and 2, there is shown a display and storage stand in accordance with the teachings of this invention, comprised of an assembly 10 including a first or lower support disc 14 of substantially circular configuration and having an opening 42 disposed centrally thereof, for receiving a standard 12, as more fully shown in FIG. 5. Further, there is provided a plurality of U-shaped brackets 22, each having a lower leg portion 22*a* and an upper leg portion 22*b*, fastened to the lower support disc 14 and to a second or spacing disc 24, respectively, so that the leg portions 22*a* and *b* extend in a substantially radial fashion with respect to the opening 42. In particular, as more clearly shown in FIG. 2, a pluarlity of fasteners 31, illustratively in the form of nuts and bolts, secure the leg portions 22*a* to the lower support disc 14, while fasteners 29 secure the leg portions 22*b* to the spacing disc 24. It is noted that by the use of nuts and bolts, that the various parts, e.g., disc 14 and bracket 22*n* may be readily assembled together with generally available tools. However, this invention is not limited to a particular type of fastening device but would include any relatively easy fastener such as screws, nails, etc.; it is further contemplated that the parts of the storage and display stand 10 of this invention could be assembled by suitable adhesives.

Figure 3:
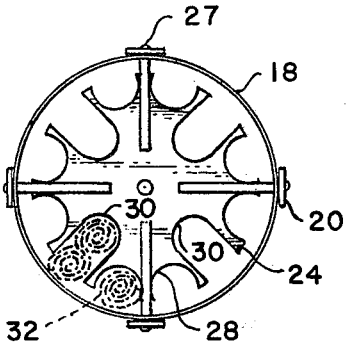
FIGS. 3 and 4 are respectively top and bottom views of the rotatable display and storage stand as shown in FIGS. 1 and 2.

As shown most clearly in FIG. 1, in one illustrative embodiment of this invention, four U-shaped brackets 22 are disposed at right angles with respect to each other with their leg portions extending radially from the opening 42, whereby bite portion 22*c* of each of the brackets 22 define a generally cylindrical space extending vertically from the opening 42. The spacing disc 24 is of substantially circular configuration and of substantially the same diameter as that of the first support disc 14. The spacing disc 24 includes, as is more clearly shown in FIG. 3, a plurality of notches 28 and 30 for receiving rolls 32 (shown in dotted line) of a sheet material such as floor covering, and in particular carpets. In particular, the notch 28 is of substantially circular configuration and is disposed at the periphery of the spacing disc 24. A notch 30 is disposed between a pair of the notches 28, and is of a larger dimension than notches 28, extending radially from the periphery of the disc 24 toward the center thereof. As illustrated in FIG. 3, the notch 30 is of sufficient dimension and configuration to receive at least two rolls 32 of floor covering. In this manner, additional samples of floor covering may be stored, especially those that are more popular and which sell faster.

As shown in FIGS. 1 and 2, a second plurality of U-shaped brackets 26 is disposed on the top or remote surface of the disc 24 with respect to the first plurality of brackets 22. In particular, each of the U-shaped brackets 26 includes a first or lower leg portion 26*a* secured to the spacing disc 24 and to a corresponding leg portion 22*b* by the fasteners 29. The U-shaped brackets 26 are disposed substantially 90° from the adjacent brackets 26 and are arrayed whereby the leg portions 26*a* and 26*b* are disposed in a radial fashion with respect to the axis of the assembly 10.

Further, as shown in FIGS. 1 and 2, the display and storage assembly 10 includes a bottom cylindrical member 16 that is disposed about the disc 14, and a top cylindrical member 18. A plurality of elongated supports 20 illustratively made of an attractive woodlike material is disposed in generally vertical orientation as shown in FIGS. 1 and 2 extending from the bottom cylindrical member 16 to the top cylindrical member 18. Four of such members 20 are disposed about the surfaces of the cylindrical member 16 and 18, spaced equally from each other and aligned with the bite portions of the U-shaped brackets 26 and 28, Thus, as shown in FIGS. 1 and 2, suitable fasteners are provided whereby the elongated supports 20 are fastened to the aforementioned leg portions. In particular, fasteners 15 are used to secure the bottom portion of each of the elongated supports 20 through the cylindrical member 16 to the leg portion 22*a*; fasteners 23 to leg portions 22*b*; fasteners 25 to leg portions 26*a*; and fasteners 27 to leg portions 26*b*. In this fashion, the plurality of elongated supports 20 and the cylindrical member 16 and 18 are assembled in a manner whereby a substantially cylindrically shaped display assembly 10 is formed.

With respect to FIG. 5, there is shown the standard 12, as comprising an upright member 40 of a generally T-shaped configuration, with leg portions 40*b* disposed at substantially right angles with a vertical portion 40*c*. Further, the standard 12, includes first and second L-shaped members 36 and 38 connected to opposite sides of the upright member 40 by a pair of suitable fasteners 33. In particular, the members 36 and 38 includes upright portions 36*b* and 38*b*, through which the fasteners are connected, and leg portions 36*a* and 38*a* extending at right angles to the vertical portion 40*c*. Thus, as more clearly shown in FIG. 4, there are four extending leg portions, 40*a* and *b*, 36*a* and 38*a* disposed at substantially right angles with respect to each other. The standard 12 is free standing upon its leg portions 40*a*, *b*, 36*a* and 38*a* with the vertical portion 40*c* extending upright.

Figure 4:
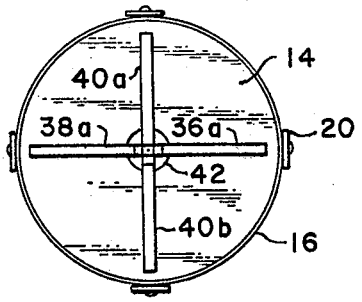

As shown in FIGS. 2 and 4, the display and storage assembly 10 is rotatably mounted upon the standard 12, with the leg portions 40*a*, *b*, 36*a* and 38*a* resting upon the floor space and the vertical portion 40*c* extending through the opening 42 within the disc 14 and into the opening or space formed by the bite portions 22*c* of each of the brackets 22. In a sense, the upright portions 36*b* and 38*b* along with the lower part of vertical portion 40*c* are journaled within the opening 42, thus centrally aligning the display and storage assembly 10 with respect to the standard 12. At the periphery of each of the leg portions 40*a* and *b*, 36*a* and 38*a*, there is disposed a bearing surface in the form of an encased ball bearing 44. As shown in FIG. 2, the lower surface of the disc 14 rests upon the ball bearings 44, whereby the display and storage assembly 10 is rotatably mounted with low friction upon the standard 12. Thus, the potential customer, may in a single position, rotate the assembly 10 whereby he may readily view each of the rolled carpets 32 carried by the assembly 10.

Thus, there has been shown and described a display and storage stand that is capable of being easily rotated to permit ready access and viewing of a large portion of the surface of a plurality of samples of rolled floor covering. Further, as readily seen in FIGS. 2 and 4, the floor space required by the display and storage stand of this invention is small. The components of the stand of this invention are capable of being shipped to the point of utilization unassembled and there assembled with the use of relatively common tools. Further, additional rolled coverings may be stored in the stand of this invention whereby those samples that are relatively popular and fast selling, may be stored therein.

During the course of the foregoing description, reference has been made to such terms as "front", "back", "top", "bottom", "up", "down", etc. It should be apparent that these are relative terms and are used to aid in the description of the component parts as used in the accompanying drawings and are not intended to limit the physical structure of the referenced member.

Numerous changes may be made in the aboveidentified apparatus and the different embodiments of the invention may be made without departing from the spririt thereof; therefore, it is intended that all matter contained in the foregoing description and in the accompanying drawings shall be interpreted as illustrative and not in a limiting sense.

I claim:

1. A display and storage rack for rolled samples of floor covering materials and the like, comprising:

a. a standard having foot portions for supporting a generally upright, vertical portion therefrom;

b. a rotative assembly comprising a first disc for supporting an end of each of the rolled sample to be displayed and a second disc spaced therefrom and having sets of recesses therein disposed about the periphery of said second disc, each said recess being of a configuration and size for receiving at least a single roll of the floor covering, and first plurality of bracket members for supporting said first and second disc in a spaced relationship, said first disc having an opening therethrough for receiving said standard, whereby said assembly is rotatively supported about said upright, vertical portion;

c. a second plurality of bracket members, each having a first leg portion fastened by fastening means to an upper surface of said second disc, a second leg portion and a connecting bite portion; and d. a lower cylindrical member and an upper cylindrical member respectively connected to said first leg portions of said first mentioned plurality of brackets and to said upper leg portion of said second plurality of brackets.

2. The storage and display stand as claimed in claim 1 wherein said first plurality of bracket members comprises a plurality of U-shaped members, each having a first leg portion secured to said first disc by fastening means, a bite portion and a second leg portion secured to said second disc by fastening means.

3. The display and storage stand as claimed in claim 2, wherein said first plurality of bracket members are aligned radially with respect to said opening of said first disc and said bite portions of said bracket members define a space aligned with respect to said opening of said first disc, whereby said upright vertical portion of said standard may be inserted through said opening of said support disc and into said space.

4. The display and storage stand as claimed in claim 1 wherein there is further included a plurality of elongated supports having ends fastened to said lower and upper cylindrical members respectively and extending substantially parallel with respect to said bite portions of said first and second brackets.

5. The display and storage stand as claimed in claim 1, further comprising a bearing surface comprising a ball bearing mounted upon the upper surface of each of said foot portions of said standard, to engage the bottom surface of said first disc to facilitate rotation of said assembly.

* * * * *